US008113882B1

(12) United States Patent
Chen

(10) Patent No.: US 8,113,882 B1
(45) Date of Patent: Feb. 14, 2012

(54) USB CONNECTOR

(75) Inventor: Po-Jung Chen, Taoyuan (TW)

(73) Assignee: U. D. Electronic Corp., Taoyuan, Taoyuan County (TW)

( * ) Notice: Subject to any disclaimer, the term of this patent is extended or adjusted under 35 U.S.C. 154(b) by 0 days.

(21) Appl. No.: 12/980,947

(22) Filed: Dec. 29, 2010

(51) Int. Cl.
*H01R 13/648* (2006.01)

(52) U.S. Cl. ..... 439/607.01

(58) Field of Classification Search ..... 439/607.01, 439/79, 724, 701, 607.4, 660
See application file for complete search history.

(56) References Cited

U.S. PATENT DOCUMENTS 8,038,474 B2 * 10/2011 Ju ..... 439/607.01
2010/0261385 A1 * 10/2010 Zheng et al. ..... 439/607.01
2011/0130036 A9 * 6/2011 Ju ..... 439/607.01
2011/0195601 A1 * 8/2011 Chen et al. ..... 439/607.01
* cited by examiner

*Primary Examiner* — Jean F Duverne
(74) *Attorney, Agent, or Firm* — Muncy, Geissler, Olds & Lowe, PLLC

(57) ABSTRACT

A USB connector includes an connector body holding first and second conducting terminals on top and bottom sides of a tongue plate of a first connection port thereof, a bottom positioning member located on the bottom side of the first connection port, an adapter board having first contacts located on the front side for the bonding of rear bonding portions of the first and second conducting terminals and first metal pads located on the rear side thereof for the bonding of the bonding portions of adapter terminals and electronic components electrically connected between the first contacts and the first metal pads, and a rear cover fastened to the rear side of the first connection port and the top side of the bottom positioning member to shield the first and second conducting terminals and the adapter terminals.

16 Claims, 14 Drawing Sheets

USB CONNECTOR

BACKGROUND OF THE INVENTION

1. Field of the Invention

The present invention relates to USB connectors and more particularly, to such a USB connector, which has a rear cover fastened to the rear side of the first connection port and the top side of the bottom positioning member to shield the first and second conducting terminals, the adapter terminals and the circuit module, prohibiting them from contacting the outer metal shield to cause a short circuit.

2. Description of the Related Art

Following fast development of modern electronic technology, many different advanced and small-sized electronic devices have been intensively used in our daily life. Nowadays, many people use notebook computer instead of desk computer for the advantage of high mobility. Further, different interface devices shall be used for data and/or signal transmission between a host and different peripheral apparatus, or among different electronic devices. USB (Universal Serial Bus) interface devices are most popularly used interface devices for the advantage of hot-plug capabilities.

An early design of USB 2.0 standard (USB Hi-Speed) improves the transmission speed from 12 Mbps up to 480 Mbps. However, this design can simply be used in a peripheral apparatus (such as card reader, printer, memory stick, network phone, and network camera) of low driving power. Nowadays, these data transmission speeds cannot satisfy the demand for quick transmission of a big amount of data within a limited time, i.e., USB2.0 cannot be used with a high capacity hard disk drive or DVD copier, DVD player or any advanced blue light electronic device. In consequence, high speed data transmission connectors have been continuously created. For example, USB 3.0 standard (USB Super-Speed) provides a transmission speed as high as 4.8 Gbps. In consideration of compatibility to conventional USB 2.0, USB 3.0 maintains the original conducting terminals and adds an extra set of conducting terminals, i.e. a USB 3.0 connector has two sets of conducting terminals arranged therein to support two-way transmission at a high speed. The enhanced power supplying capability of USB 3.0 standard allows the use of a detachable high-capacity hard disk drive without extra power supply, and also permits connection of extra peripheral apparatus.

FIG. 14 illustrates a conventional USB 2.0 multi-port connector. According to this design, the USB 2.0 multi-port connector comprises a connector body A, an upper row of conducting terminals B, a bottom row of conducting terminals C and a metal shield D. The connector body A defines therein a first connection port A1 and a second connection port A2. The upper row of conducting terminals B and the bottom row of conducting terminals C are respectively mounted in the first connection port A1 and second connection port A2 of the connector body A. The conducting terminals B;C each have a signal input end B1;C1 extended out of the connector body A and bonded to an external circuit board, and a signal output end B2;C2 suspending in the first connection port A1 or second connection port A2 at the bottom side. The metal shielding shell C surrounds the connector body A, comprising a front shell D1, a back shell D2 and a middle clamping plate D3. The front shell D1, the back shell D2 and the middle clamping plate D3 are assembled together for grounding and electromagnetic protection. During application, the first connection port A1 and second connection port A2 of the connector body A can receive a respective external USB 2.0 connector for signal transmission between electronic apparatus.

Based on the design of the aforesaid USB2.0 female connector, extra conducting terminals may be installed in the connector body A to constitute a USB3.0 female connector. However, due to limited internal space, it is difficult to install an extra row of conducting terminals in the connector body A. Further, when a big number of conducting terminals are installed in the connector body A, signal transmission interference may occur, lowering the signal transmission quality and increasing the risk of electromagnetic interference. Further, after installation, the upper row of conducting terminals B and the bottom row of conducting terminals C may touch the metal shield D accidentally, causing a short circuit and increasing product defective rate.

Therefore, it is desirable to provide a USB connector, which eliminates the drawbacks of conventional USB2.0 multi-port connectors.

SUMMARY OF THE INVENTION

The present invention has been accomplished under the circumstances in view. Therefore, it is the main object of the present invention to provide a USB connector, which has an electrically insulative rear cover fastened to the rear side of the first connection port and the top side of the connection member of bottom positioning member to shield the rear bonding portions of the first conducting terminals and second conducting terminals, the adapter terminals and the circuit module and to prohibit them from contacting the outer metal shield to cause a short circuit. Further, the rear cover has a plurality of locating flanges respectively from the front side and bottom sides thereof and respectively engaged into a receiving chamber and locating grooves of the connector body, assuring installation stability.

Further, the adapter board of the circuit module of the USB connector comprises two rows of first metal contacts and second metal contact for the bonding of the connection portions of the metal connection terminals and the connection portions of the adapter terminals respectively by means of surface mount technology so that the surface space of the adapter board can be fully utilized for the installation of electronic components to maintain their electric properties for best performance.

Further, the first connection port has the bottom side thereof mounted with a bottom positioning member. In an alternate form of the invention, the USB connector comprises a first connection port and a second connection port defined in the connector body thereof, a bottom positioning member located on the bottom side of the second connection port, a connection block located on the rear side of the bottom positioning member, and a metal shield surrounding the connector body for grounding. The first and second conducting terminals of the first and second connection ports and the metal connection terminals held in the connection block are well shield and isolated, avoiding electromagnetic interference. The electrically insulative component parts are conveniently fastened by hooking, assuring high connection stability for plugging and unplugging of an external USB connector.

Further, electronic components are installed in the adapter board. The adapter board comprises a set of first contacts and a set of second contact for the bonding of the rear bonding portion of the first conducting terminals and second conducting terminals of the first connection port and the rear bonding portion of the first conducting terminals and second conducting terminals of the second connection port respectively, and a set of first metal pads and a set of second metal pads respectively arranged at the rear side thereof corresponding to the electronic components. The electronic components include filter devices that can be CMC (common mode chokes), filter resistors and/or filter capacitors, and protection devices that can be TVS (transient voltage suppressor and/or varistor for protection against surge and/or static electricity. Thus, the electronic components of the adapter board effectively remove noises, electromagnetic interference, transient voltage, surge or static electricity during signal transmission, assuring signal transmission quality and reliability and avoiding signal interrogation or signal transmission failure.

DETAILED DESCRIPTION OF THE PREFERRED EMBODIMENT

Figure 1:
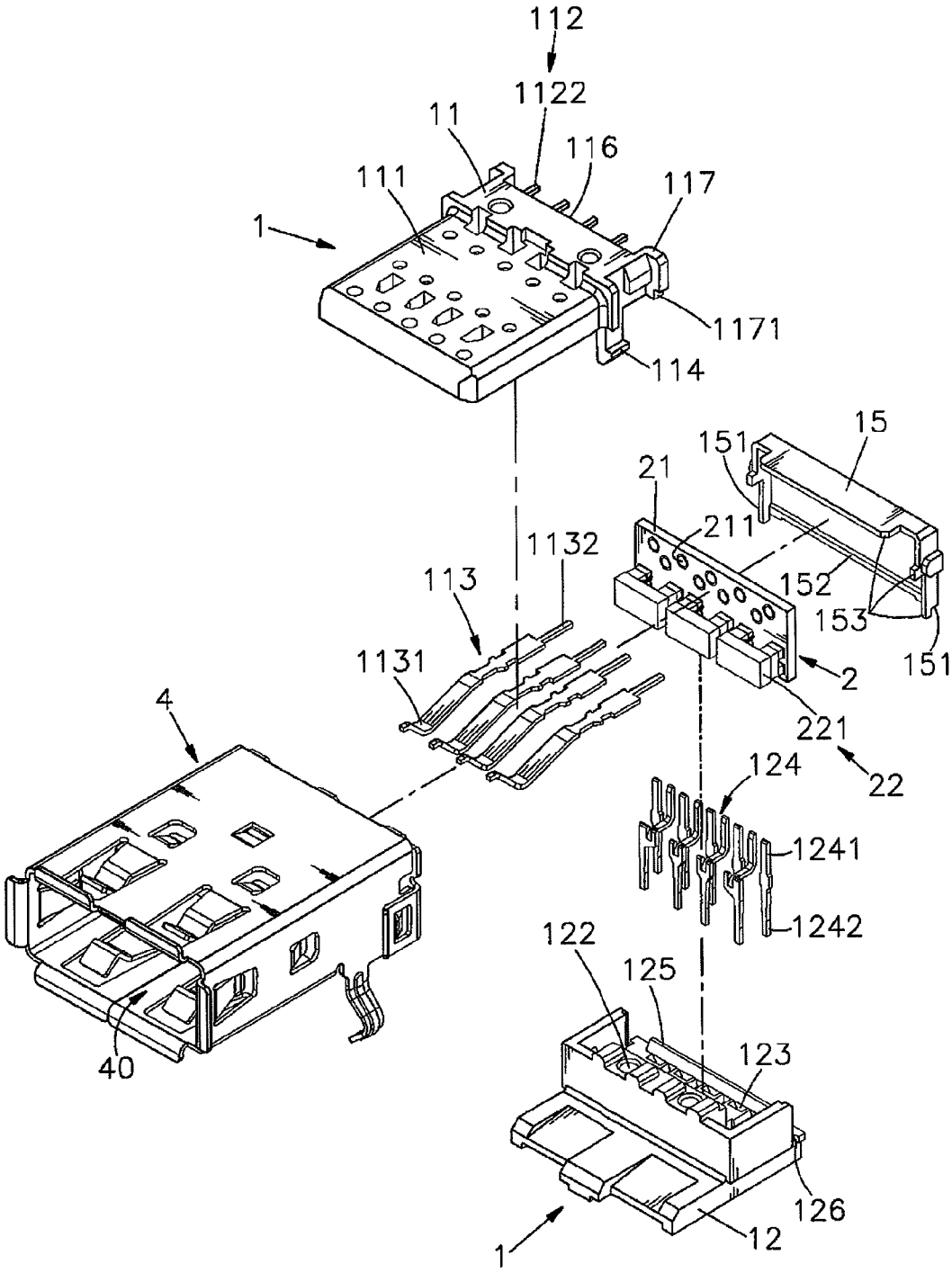
FIG. 1 is an exploded view of a USB connector in accordance with a first embodiment of the present invention.

Referring to FIGS. 1~4, a USB connector in accordance with a first embodiment of the present invention is shown comprising a connector body 1, a circuit module 2 and a metal shield 4.

The connector body 1 comprises a first connection port 11 and a bottom positioning member 12 fastened to the bottom side of the first connection port 11. The first connection port 11 comprises a forwardly extending tongue plate 111 having multiple bottom terminal grooves 1111, a set of first conducting terminals 112 mounted in the top side of the tongue plate 111, a set of second conducting terminals 113 mounted in the bottom terminal grooves 1111 of the tongue plate 111. The first conducting terminals 112 and second conducting terminals 113 have the respective front contact portions 1121 or 1131 suspending below the tongue plate 111 and arranged in two rows and the respective rear bonding portions 1122 or 1132 extending out of the rear side of the first connection port 11. The first connection port 11 further comprises a plurality of bottom hooks 114 and bottom mounting rods 115. The bottom positioning member 12 comprises a plurality of retaining blocks 121 and retaining holes 122 disposed at the top side thereof, multiple terminal slots 123 vertically cut through the top and bottom sides near the rear side thereof and holding a set of adapter terminals 124. Each adapter terminal 124 has one end terminating in a connection portion 1241 and the other end terminating in a bonding portion 1242.

The circuit module 2 comprises an adapter board 21 carrying a circuit layout, and a plurality of electronic components 22 installed in the adapter board 21. The electronic components 22 include filter devices 221 that can be CMC (common mode chokes), filter resistors and/or filter capacitors, and protection devices 222 that can be TVS (transient voltage suppressor and/or varistor for protection against surge and/or static electricity. According to this embodiment, 6 filter devices 221 are arranged in two rows on the front side of the adapter board 21; 3 protection devices 222 are arranged in a row and spaced between the two rows of filter devices 221. The adapter board 21 comprises a set of first contacts 211 and a set of second contacts 212 respectively arranged in a row above one respective row of filter devices 221 for the bonding of the rear bonding portion 1122;1132 of the first conducting terminals 112 and second conducting terminals 113 of the first connection port 11 respectively, and a set of first metal pads 213 arranged at the rear side thereof corresponding to the electronic components 22. The connection portions 1241 of the adapter terminals 124 are respectively bonded to the first metal pads 213 of the adapter board 21.

The metal shield 4 surrounds the connector body 1 and the circuit module 2, defining a front insertion hole 44 for receiving an external USB connector.

During installation, the rear bonding portion 1122;1132 of the first conducting terminals 112 and second conducting terminals 113 of the first connection port 11 are respectively electrically bonded to the first contacts 211 of the adapter board 21, and then the bottom hooks 114 and bottom mounting rods 115 of the first connection port 11 are respectively fastened to the respective retaining blocks 121 and retaining holes 122 of the bottom positioning member 12. Thus, the first connection port 11 and the bottom positioning member 12 are fastened together. Thereafter, the connection portions 1241 of the adapter terminals 124 are respectively bonded to the first metal pads 213 of the adapter board 21 by SMT (surface mount technology). At final, fasten the metal shield 4 to the outside wall of the connector body 1, finishing the assembly process of the USB 3.0 connector.

FIGS. 5~8 illustrate a USB connector in accordance with a second embodiment of the present invention. As illustrated, the USB connector in accordance with this second embodiment of the present invention comprises a connector body 1, a circuit module 2, a connection block 3 and a metal shield 4.

The connector body 1 comprises an electrically insulative base member 13, a first connection port 11 and a second connection port 14 respectively arranged at the top and bottom sides of the electrically insulative base member 13 and a bottom positioning member 12 arranged at the bottom side of the second connection port 14. According to this embodiment, the electrically insulative base member 13 comprises a plurality of retaining blocks 131 and retaining holes 132 disposed at the top side thereof, a plurality of bottom hooks 133 and bottom mounting rods 134 located on the bottom side thereof.

The first connection port 11 comprises a forwardly extending tongue plate 111 having multiple bottom terminal grooves 1111, a set of first conducting terminals 112 and a set of second conducting terminals 113 mounted in the top and bottom sides of the tongue plate 111 in a parallel manner. The second conducting terminals 113 are respectively positioned in the bottom terminal grooves 1111 of the tongue plate 111. The first conducting terminals 112 and the second conducting terminals 113 each have a front contact portion 1121 or 1131 suspending below the tongue plate 111, and a rear bonding portion 1122 or 1132 extending out of the rear side of the first connection port 11. The first connection port 11 further comprises a plurality of bottom hooks 115 and bottom mounting rods 116. The first conducting terminals 113 and second conducting terminals 114 of the first connection port 11 each have a front contact portion 1131 or 1141 suspending below the tongue plate 111, and a rear bonding portion 1132 or 1142 extending out of the rear side of the first connection port 11. The second connection port 14 comprises a forwardly extending tongue plate 141 having multiple bottom terminal grooves 1411, and a set of first conducting terminals 142 and a set of second conducting terminals 143 mounted in the top and bottom sides of the tongue plate 141 in a parallel manner. The second conducting terminals 143 are respectively positioned in the bottom terminal grooves 1411 of the tongue plate 141. The first conducting terminals 142 and the second conducting terminals 134 each have a front contact portion 1421 or 1431 suspending below the tongue plate 141, and a rear bonding portion 1422 or 1432 extending out of the rear side of the second connection port 14. The second connection port 14 further comprises a plurality of retaining blocks 144 and retaining holes 145 disposed at the top side and a plurality of bottom hooks 146 and bottom mounting rods 147 disposed at the bottom side.

The circuit module 2 comprises an adapter board 21 carrying a circuit layout, and a plurality of electronic components 22 installed in the adapter board 21. The adapter board 21 comprises a set of first contacts 211 and a set of second contacts 212 respectively arranged in a row above one respective row of filter devices 221 for the bonding of the rear bonding portion 1122;1132 of the first conducting terminals 112 and second conducting terminals 113 of the first connection port 11 and the rear bonding portion 1422;1432 of the first conducting terminals 142 and second conducting terminals 143 of the second connection port 14 respectively, and a set of first metal pads 213 and a set of second metal pads 214 respectively arranged at the rear side thereof corresponding to the electronic components 22.

The connection block 3 comprises a plurality of terminal slots 31 vertically extending through top and bottom sides thereof, and a plurality of locating grooves 33 located on the top side thereof and respectively extended from the top ends of the terminal slots 31. Further, metal connection terminals 32 are respectively mounted in the terminal slots 31. Each metal connection terminal 32 has a connection portion 321 located on its one end and a bonding portion 322 located on its other end, and a curved middle portion 323 connected between the connection portion 321 and the bonding portion 322. The bonding portions 322 of the metal connection terminals 32 extend out of the terminal slots 31 for bonding to an external circuit board. The curved middle portions 323 of the metal connection terminals 32 are respectively positioned in the locating grooves 33.

The metal shield 4 includes a front frame shell 41, a rear cover shell 42 and an internal clamping shell 43. The front frame shell 41 and the rear cover shell 42 are fastened together and covered over the connector body 1. The internal clamping shell 43 is clamped on the electrically insulative base member 13 of the connector body 1, and stopped against spring lugs 411 of the front frame shell 41. Further, the internal clamping shell 43 divides the internal space of the front frame shell 41 into two insertion holes 40 for receiving one respective external USB connector.

When assembling the first connection port 11 and second connection port 14 of the connector body 1 with the insulative base member 13 and the bottom positioning member 12, the bottom hooks 115 of the first connection port 11 and the bottom mounting rods 147 of the second connection port 14 are respectively engaged into the retaining holes 122 of the bottom positioning member 12 and the retaining holes 132 of the electrically insulative base member 13.

Figure 5:
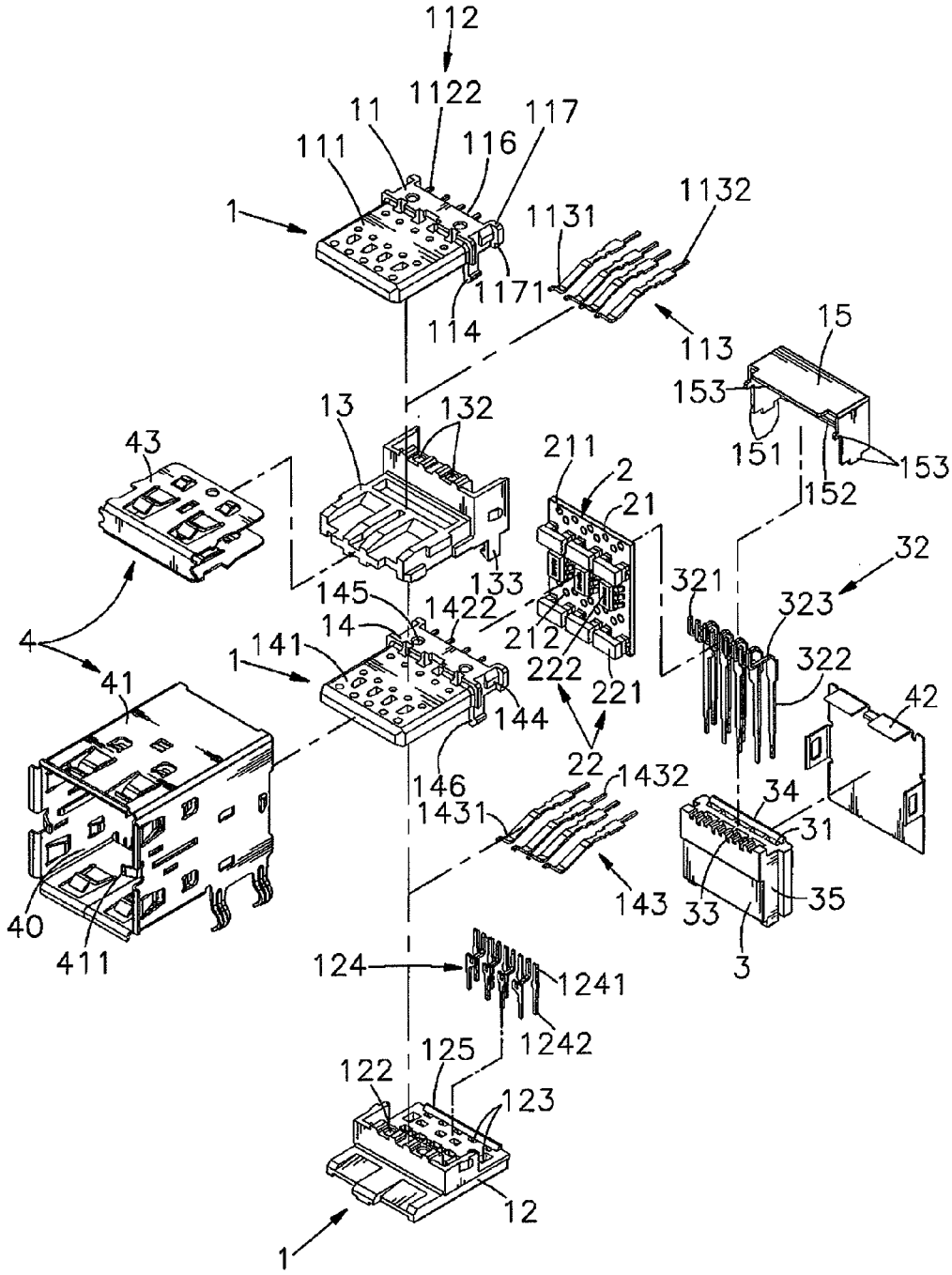
FIG. 5 is an exploded view of a USB connector in accordance with a second embodiment of the present invention.
Figure 6:
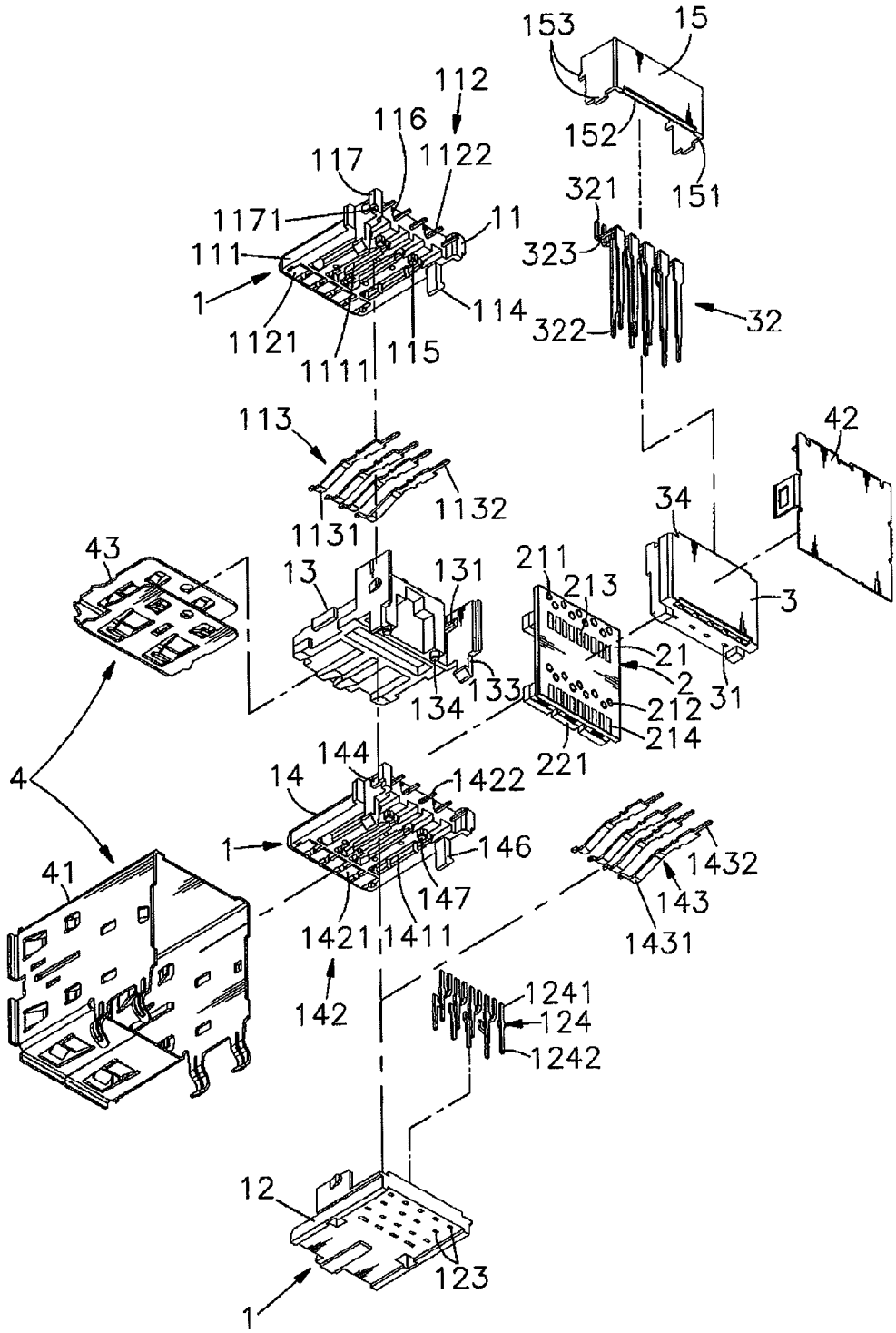
FIG. 6 corresponds to FIG. 5 when viewed from another angle.
Figure 7:
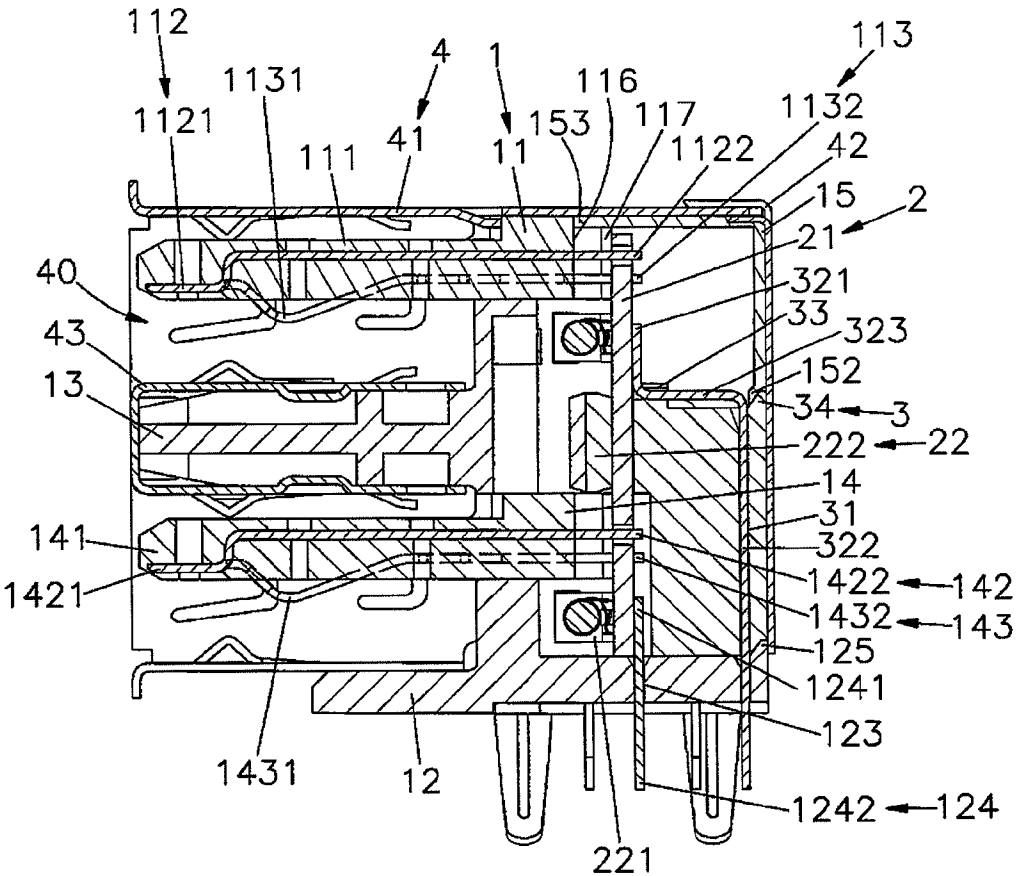
FIG. 7 is a sectional side view of the USB connector in accordance with the second embodiment of the present invention.
Figure 8:
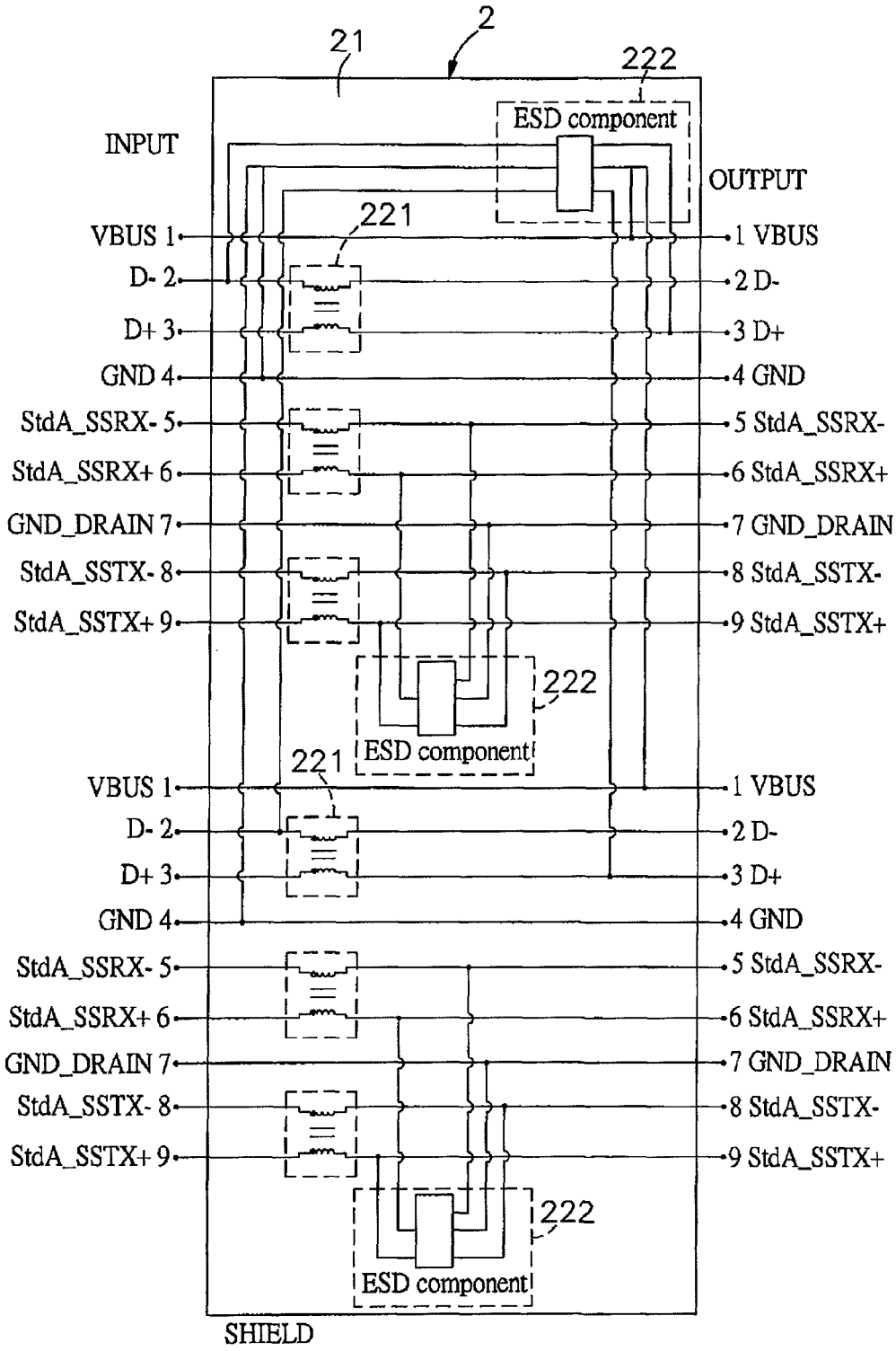
FIG. 8 is a circuit diagram of the USB connector in accordance with the second embodiment of the present invention (I).
Figure 9:
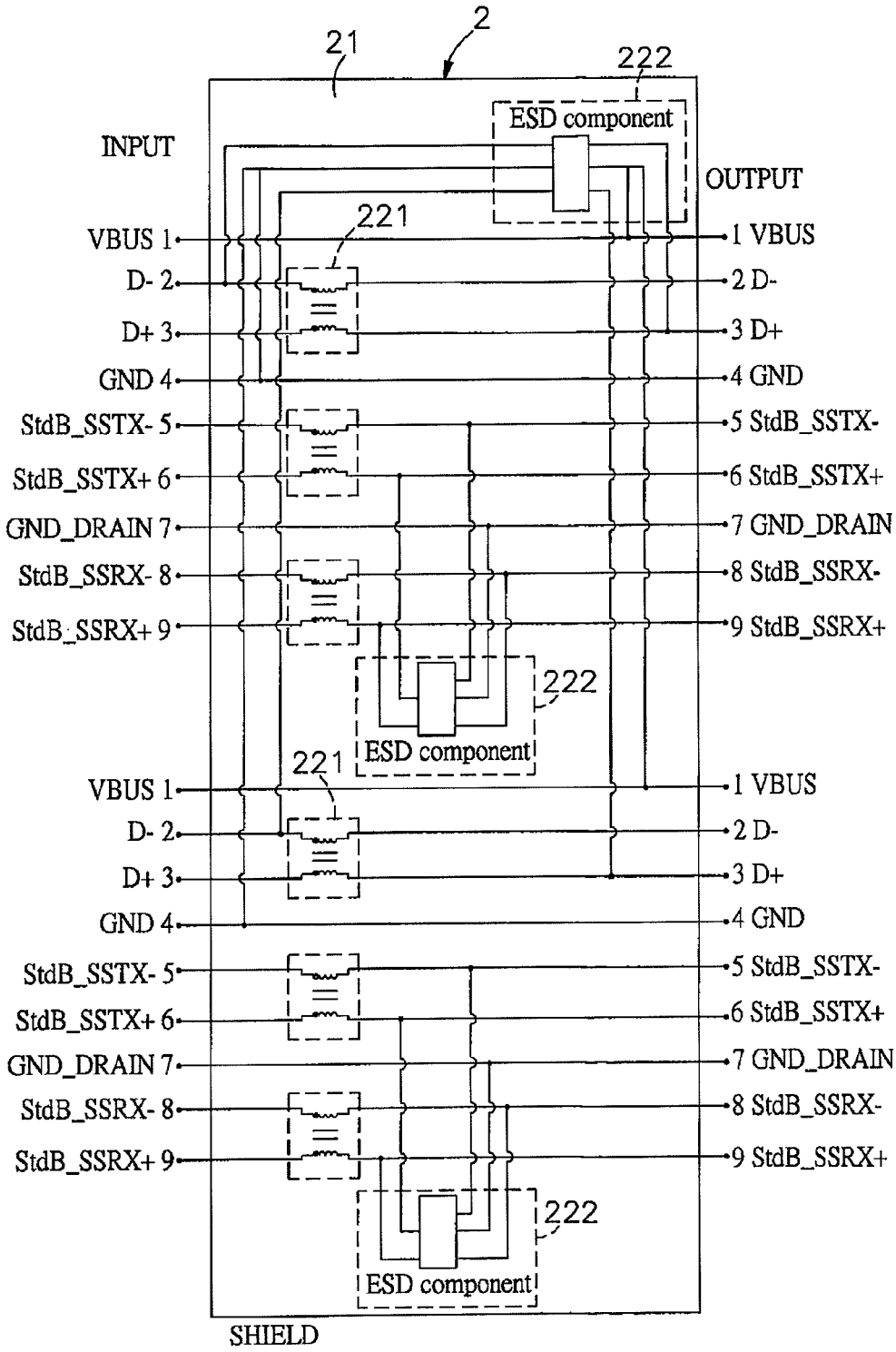
FIG. 9 is a circuit diagram of the USB connector in accordance with the second embodiment of the present invention (II).
Figure 10:
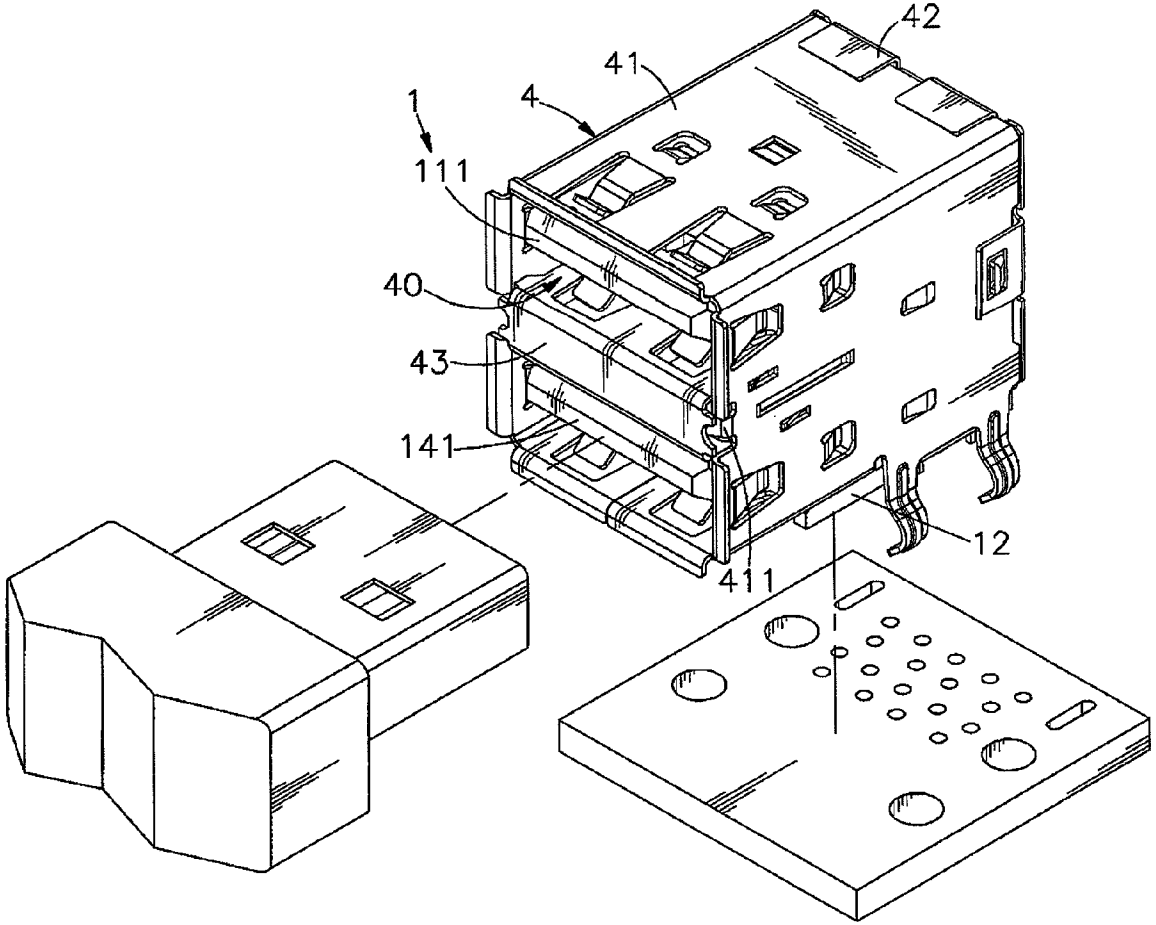
FIG. 10 is a schematic applied view of the second embodiment of the present invention.
Figure 11:
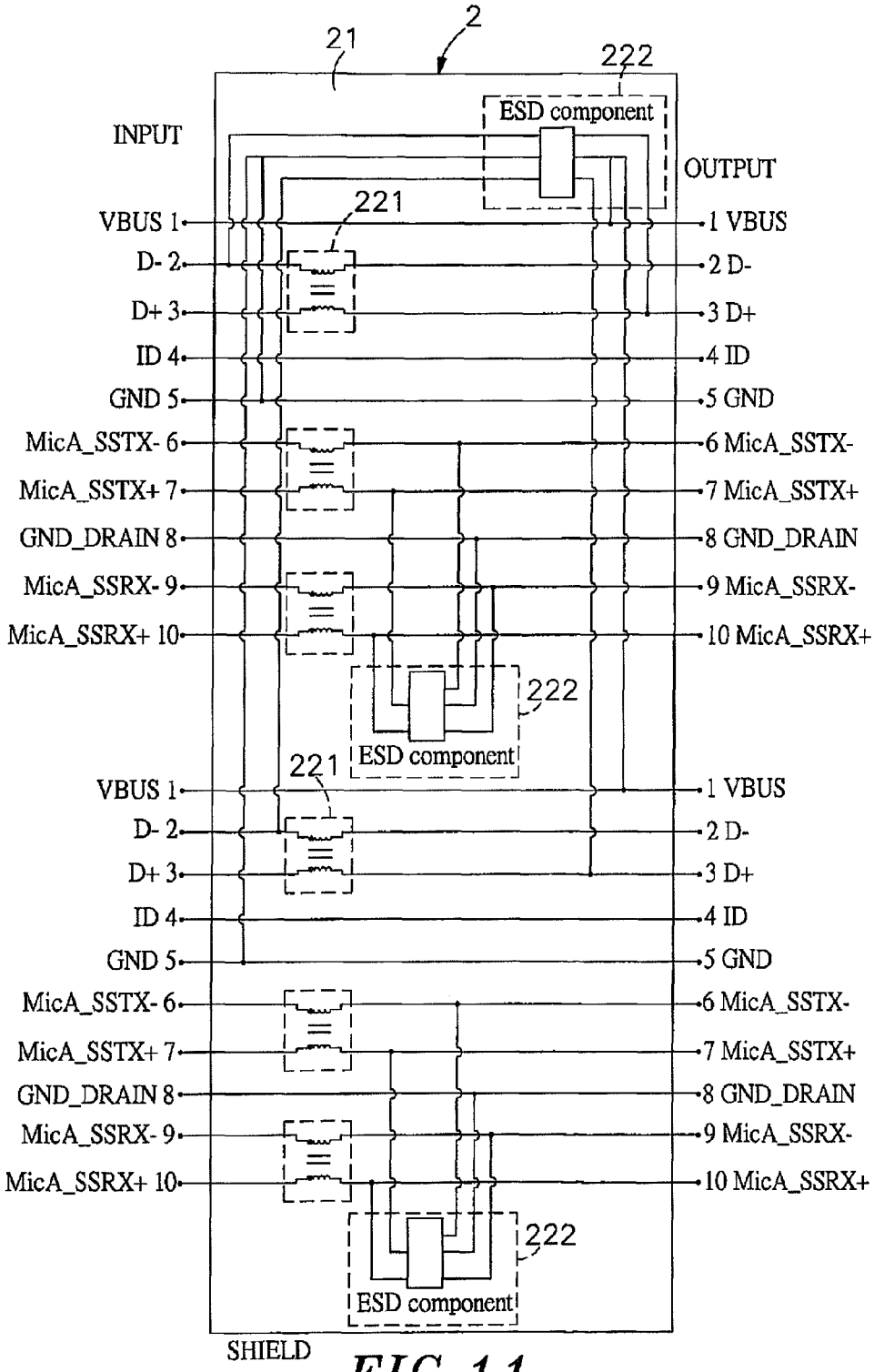
FIG. 11 is a circuit diagram of the USB connector in accordance with the second embodiment of the present invention (III).
Figure 12:
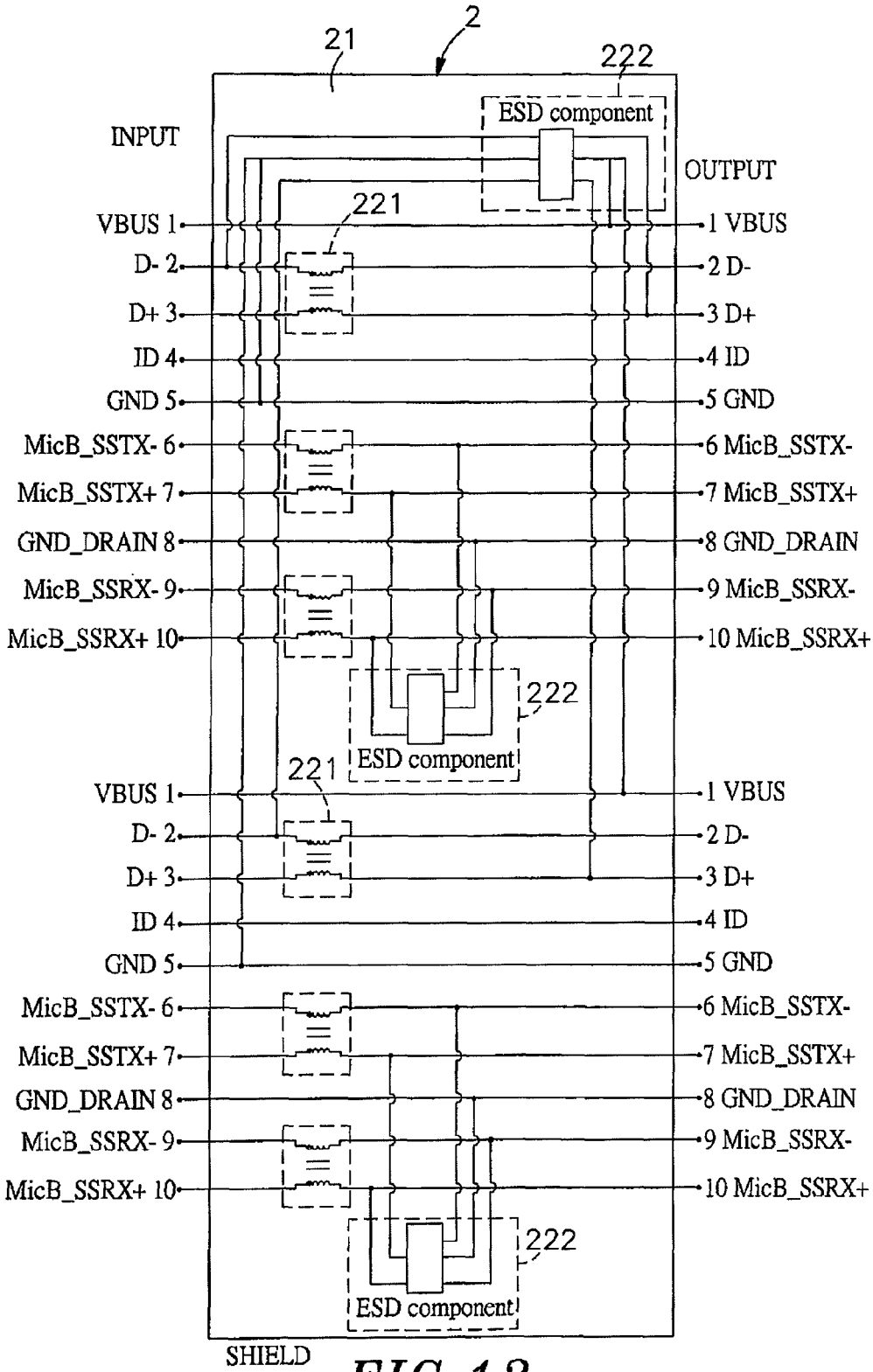
FIG. 12 is a circuit diagram of the USB connector in accordance with the second embodiment of the present invention (IIII).
Figure 13:
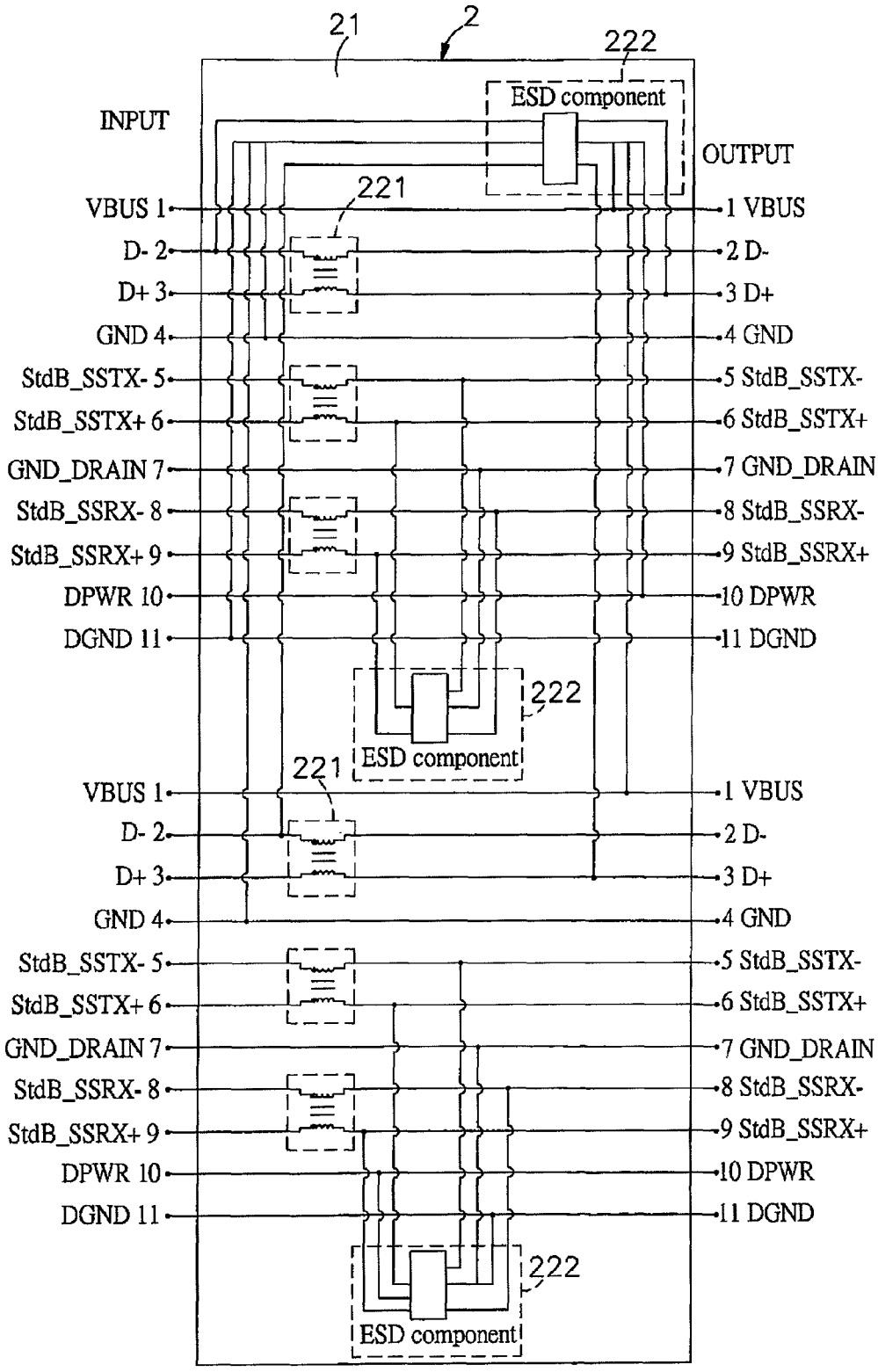
FIG. 13 is a circuit diagram of the USB connector in accordance with the second embodiment of the present invention (V).
Figure 14:
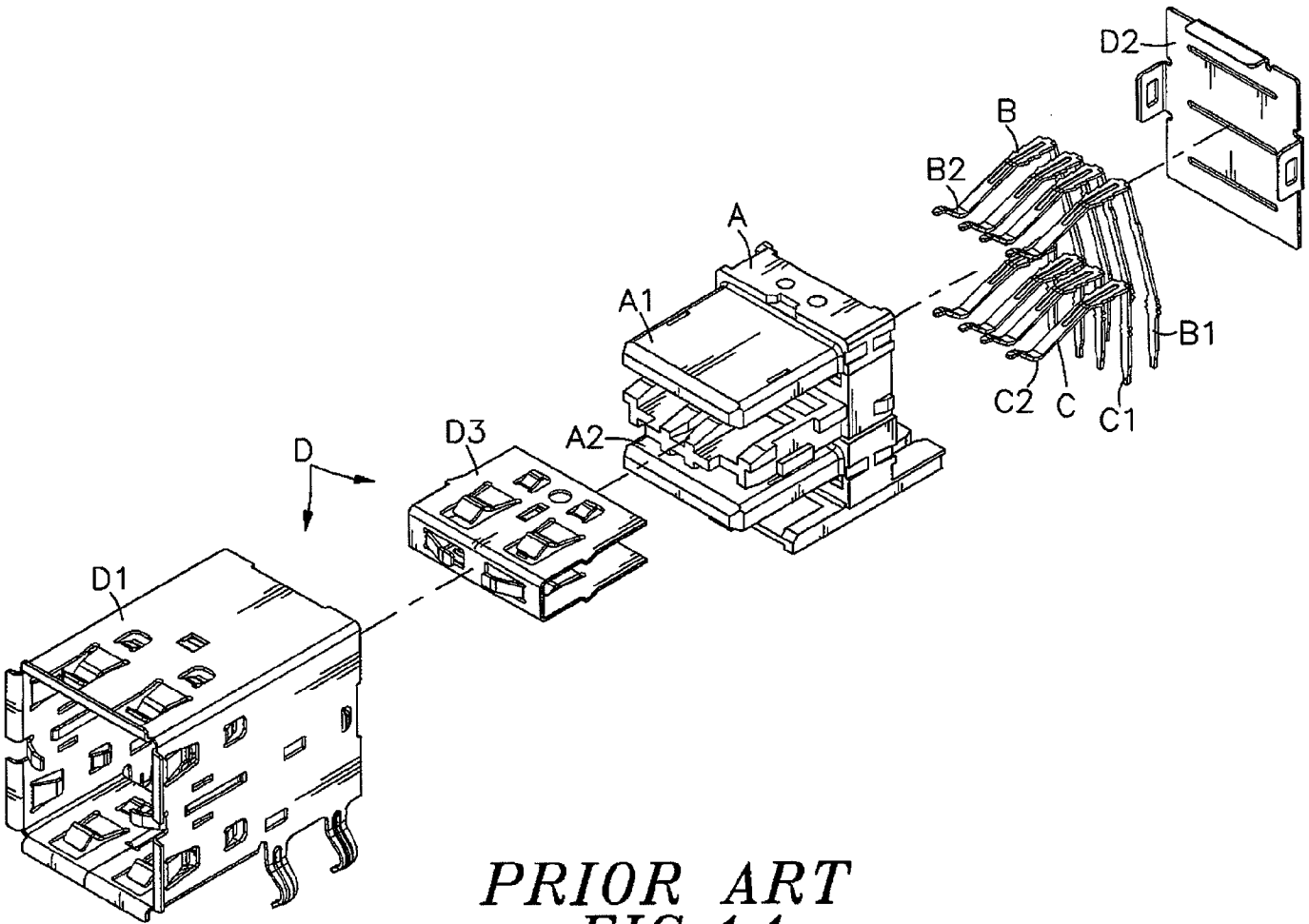
PRIOR ART FIG. 14
FIG. 14 is an exploded view of a USB connector according to the prior art.

During installation, as shown in FIGS. 5~7, force the bottom hooks 114 of the first connection port 11 into engagement with the retaining blocks 131 of the electrically insulative base member 13 to have the bottom mounting rods 115 of the first connection port 11 be respectively fitted into the retaining holes 132 of the electrically insulative base member 13. Thus, the first connection port 11 and the electrically insulative base member 13 are connected together. Thereafter, force the bottom hooks 133 of the electrically insulative base member 13 into engagement with the retaining blocks 144 of the second connection port 14 to have the bottom mounting rods 134 of the electrically insulative base member 13 be respectively fitted into the retaining holes 145 of the second connection port 14. Thus, the second connection port 14 and the electrically insulative base member 13 are connected together.

Thereafter, bond the rear bonding portions 1122;1232 of the first conducting terminals 112 and second conducting terminals 113 of the first connection port 11 electrically to the first contacts 211 of the adapter board 21, and then bond the rear bonding portions 1422;1432 of the first conducting terminals 142 and second conducting terminals 143 of the second connection port 14 electrically to the second contacts 212 of the adapter board 21, and then force the bottom hooks 146 of the second connection port 14 into engagement with the retaining holes 121 of the bottom positioning member 12 to have the bottom mounting rods 147 of the second the second connection port 14 be respectively fitted into the retaining holes 122 of the bottom positioning member 12. Thus, the second connection port 14 and the bottom positioning member 12 are connected together. Thereafter, bond the connection portions 1241 of the adapter terminals 124 of the bottom positioning member 12 to the first metal pads 213 of the adapter board 21 by surface mount technology, and then attach the connection block 3 to the rear side of the bottom positioning member 12 to let the bonding portions 322 of the metal connection terminals 32 be inserted through respective vertical terminal slots 123 of the bottom positioning member 12, and then bond the connection portions 321 of the metal connection terminals 32 to the second metal pads 214 of the adapter board 21 by surface mount technology, and then mount the metal shield 4 around the connector body 1 to keep the first connection port 11 and the second connection port 14 in the insertion holes 40. Thus, the USB 3.0 connector is assembled.

Referring to FIGS. 6, 7, 8, 9, and 10, the bonding portions 1242 of the adapter terminals 124 of the bottom positioning member 12 and the bonding portions 322 of the metal connection terminals 32 are respectively vertically extending through the vertical terminal slots 123 of the bottom positioning member 12 and bonded to an external circuit board. Further, the internal clamping shell 43 of the metal shield 4 is clamped on the electrically insulative base member 13 of the connector body 1 and stopped against the spring lugs 411 of the front frame shell 41. After bonding of the bonding portions 1242 of the adapter terminals 124 of the bottom positioning member 12 and the bonding portions 322 of the metal connection terminals 32 to the external circuit board, the metal shield 4 is bonded with its bottom legs into respective via holes of the circuit board to form a grounding loop for discharge of surrounding electromagnetic waves and noises from the adapter board 21 to the grounding terminal of the circuit board.

During application of the present invention, an external USB connector is inserted into one insertion hole 40 of the metal shield 4 and attached to the first connection port 11 or second connection port 12. At this time, the inserted external USB connector is electrically connected to the first conducting terminals 112 and second conducting terminals 113 of the first connection port 11 or the first conducting terminals 142 and second conducting terminals 143 of the second connection port 12 for two-way signal transmission. Thus, external signals can be transmitted through the first conducting terminals 112;142 and second conducting terminals 113;143 of the first and second connection ports 11;14 to the first contacts 211 of the adapter board 21 and the second conducting terminals 143, enabling the electronic components 22 to remove the unnecessary noises and electromagnetic interference. After filtration by the electronic components 22, the signal is transmitted through the first metal pads 213 or second metal pads 214, the adapter terminals 124 or metal connection terminals 32 to the microprocessor, control chip or control IC of the circuit board for signal conversion and serial data output. Thus, the electronic components 22 of the adapter board 21 effectively remove noises, electromagnetic interference, transient voltage, surge or static electricity during signal transmission, assuring signal transmission quality and reliability and avoiding signal interrogation or signal transmission failure.

The aforesaid embodiment is simply an example of the present invention but not intended as a limitation. The adapter board 21 has electronic components 22 connected between its signal input ends and its signal output ends. The circuit arrangement of the embodiment in which the connector body 1 simply comprises one first connection port 11 is same as the circuit arrangement of the embodiment in which the connector body 1 comprises one first connection port 11 and one second connection port 14. Thus, the circuit arrangement of the embodiment in which the connector body 1 comprises one first connection port 11 and one second connection port 14 is explained hereinafter for understanding. The adapter board 21 has 18 signal input ends. These 18 signal input ends are respectively electrically connected to the metal connection terminals 32 and the adapter terminals 124 through the first metal pads 213 and second metal pads 214 of the adapter board 21. Further, the adapter board 21 has 18 signal output ends for signal output. These 18 signal output ends are respectively electrically connected to the first conducting terminals 112;142 and second conducting terminals 113;143 of the first and second connection ports 11;14 through the first contacts 212 and second contacts 212 of the adapter board 21. In the first conducting terminals 112;142, a grounding terminal (GND_DRAIN) is set in between each of the two pairs of signal terminals (StdA_SSRX−;StdA_SSRX+ and StdA_SSTX−;StdA_SSTX+). In the second conducting terminals 113;143, a power terminal (VBUS) and a power grounding terminal (GND) are respectively arranged at the left and right sides of the pair of signal terminals (D− and D+).

Further, the electronic components 22 include filter devices 221 that can be CMC (common mode choke), filter resistor and/or filter capacitor, and protection devices 222 that can be TVS (transient voltage suppressor) and/or varistor for protection against surge and/or static electricity. According to this embodiment, 6 filter devices 221 are arranged in two rows and electrically connected between the signal input ends and signal output ends of the adapter board 21, i.e., the 6 filter devices 221 are electrically connected between the signal input ends and signal output ends of the adapter board 21 to which the signal terminals (StdA_SSRX−, StdA_SSRX+, StdA_SSTX−, StdA_SSTX+, D− and D+) of the first conducting terminals 112;142 and the second conducting terminals 113;143 are electrically connected.

Further, 3 protection devices 222 are electrically connected in parallel to the filter devices 221 between the signal input ends and signal output ends of the adapter board 21 to which the signal terminals (StdA_SSRX−, StdA_SSRX+, GND_DRAIN, StdA_SSTX−, StdA_SSTX+) of the second conducting terminals 113;143 are electrically connected. The signal input ends and signal output ends of the adapter board 21 to which the power terminals (VBUS) of the second conducting terminals 113;143 are electrically connected are respectively electrically connected to one pin of each of the protection devices 222. The signal input ends and signal output ends of the adapter board 21 to which the power grounding terminals (GND) of the second conducting terminals 113;143 are electrically connected are respectively electrically connected to the other pin of each of the protection devices 222. The number and/or specifications of the electronic components 22 may be changed subject to different requirements. Thus, an external signal can be transmitted through the first conducting terminals 112 and second conducting terminals 113 of the first connection port 11 or the first conducting terminals 142 and second conducting terminals 143 of the second connection port 14 to the electronic components 22, enabling the electronic components 22 to remove noises, electromagnetic interference, transient voltage, surge or static electricity, assuring signal transmission quality and reliability and avoiding signal interrogation or signal transmission failure.

Referring to FIGS. 6, 8, 9, 11, 12, and 13, in the aforesaid examples, the first conducting terminals 112;142 and second conducting terminals 113;143 are configured subject to USB 3.0 standard-A standard. A signal grounding terminal (GND_DRAIN) may be set in between each of the two pairs of signal terminals (StdB_SSTX−;StdB_SSTX+ and StdB_SSRX−; StdB_SSRX+) of the second conducting terminals 113;143 to meet USB 3.0 standard-B standards. A power terminal (DPWR) and a power grounding terminal (DGND) are be properly arranged at one side relative to one pair of signal terminals (StdB_SSRX−; StdB_SSRX+) of the second conducting terminals 113;143 far from the signal grounding terminal (GND_DRAIN) to meet USB 3.0 Powered-B standards. The two pairs of power terminals (DPWR) and power grounding terminals (DGND) are respectively connected in parallel to the protection devices 222. Further, an identification terminal (ID) may be connected between the signal terminal (D+) and power grounding terminal (GND) of the first conducting terminals 112 or 142, and a signal grounding terminal (GND DRAIN) is set between the two pairs of signal terminals (MicA_SSTX−; MicA_SSTX+; MicA_SSRX−; MicA_SSRX+; MicA_SSRX+, or MicB_SSTX−; MicB_SSTX+; MicB_SSRX−; MicB_SSRX+; MicB_SSRX+) to meet USB 3.0 Micro-AB/A/B standards. Other equivalent alternations may be adopted without departing from the spirit and scope of the invention.

When connecting the first conducting terminals 112 and second conducting terminals 113 of the first connection port 11 and the first conducting terminals 142 and second conducting terminals 143 of the second connection port 14 to the adapter board 21 of the circuit module 2, the first contacts 211 and the second contacts 212 can be respectively arranged in two rows with 5 contacts at the top side and the other 4 contacts at the bottom side in a staggered manner. Alternatively, the second contacts 212 can be arranged in a rectangular array below the first contacts 211 wherein the signal terminals (D_, D+) of the second conducting terminals 113; 143 are downwardly arranged between the signal terminal (StdA_SSTX+) and signal grounding terminal of the first conducting terminals 112;142; the power terminal (VBUS) and power grounding terminal (GND) of the second conducting terminals 113;143 are downwardly arranged between the signal terminal (StdA_SSRX−) and signal grounding terminal of the first conducting terminals 112;142. Further, a power grounding terminal (DGND) may be respectively arranged blow the space between the signal terminals (StdA_SSTX−, StdA_SSTX+) of the first conducting terminals 112;142, and a power terminal (DPWR) may be respectively arranged blow the space between the signal terminals (StdA_SSRX−, StdA_SSRX+) of the first conducting terminals 112;142, The power grounding terminals (DGND) and the power terminals (DPWR) are respectively set in alignment between the signal terminals (D−, D+) of the second conducting terminals 113; 143, or between the power terminal (VBUS) and the power grounding terminal (GND). Other equivalent alternations may be adopted to meet USB 3.0 standards without departing from the spirit and scope of the invention.

Figure 2:
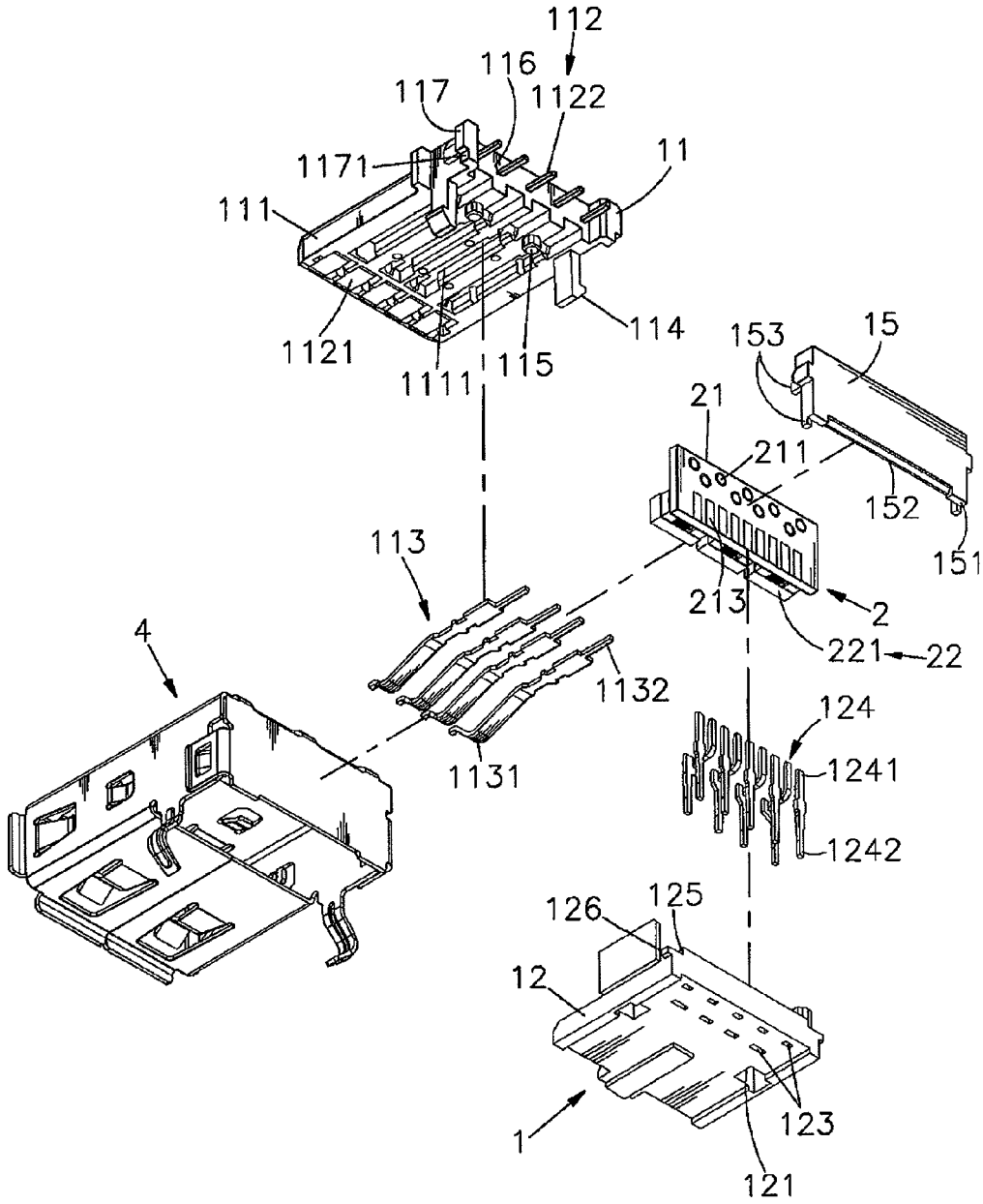
FIG. 2 corresponds to FIG. 1 when viewed from another angle.
Figure 3:
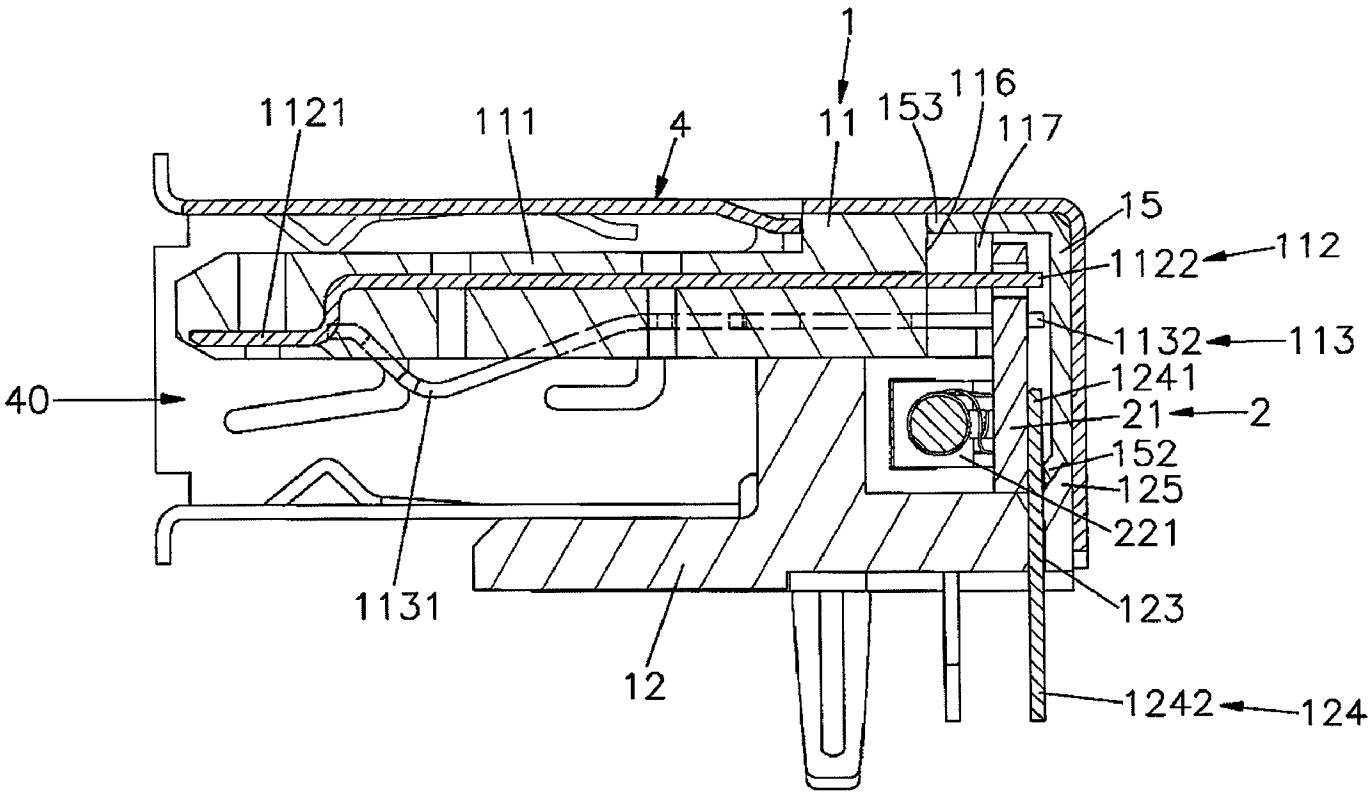
FIG. 3 is a sectional side view of the USB connector in accordance with the first embodiment of the present invention.
Figure 4:
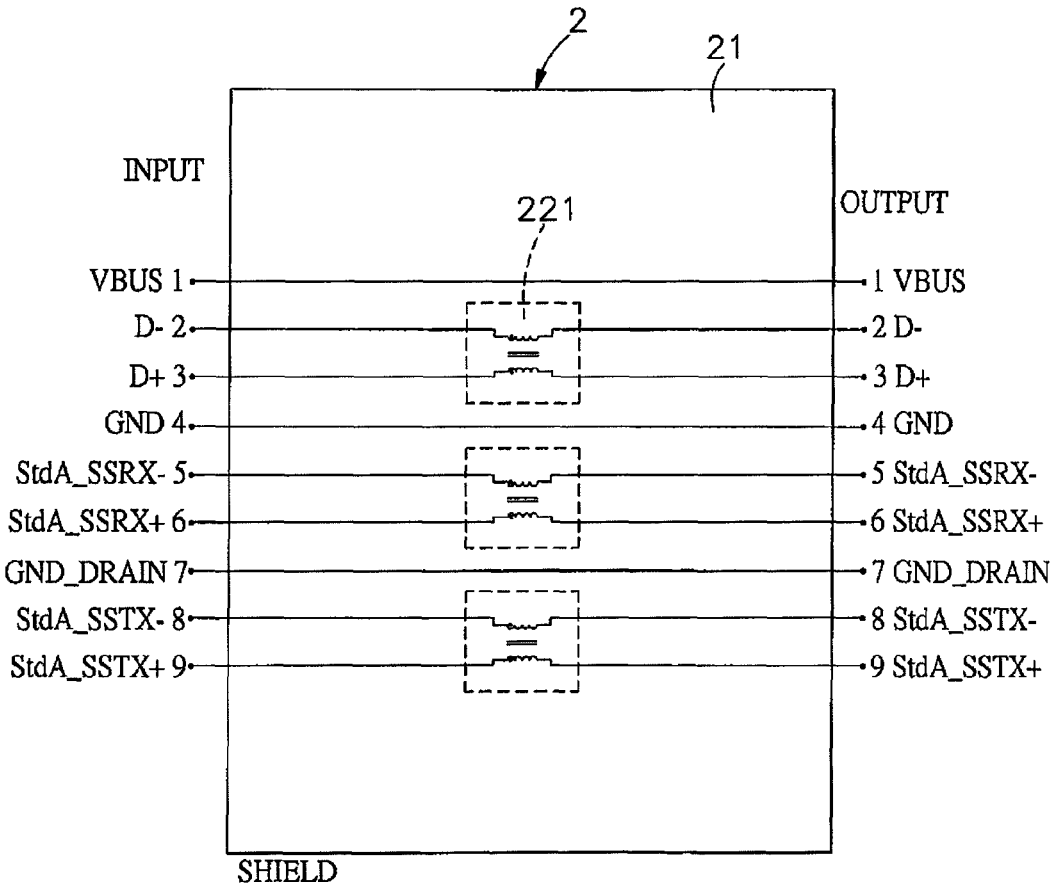
FIG. 4 is a circuit diagram of the USB connector in accordance with the first embodiment of the present invention.

Referring to FIGS. 1~3 again, further, the tongue plate 111 of the first connection port 11 of the connector body 1 comprises a receiving chamber 116 located on the rear side thereof for accommodating the circuit module 2, and two lugs 117 respectively vertically disposed at the two opposite lateral sides of the receiving chamber 116. Each lug 117 has a locating groove 1171 located on the bottom side thereof. The bottom positioning member 12 further comprises a stop block 125 protruded from the top wall thereof at a rear side relative to the terminal slots 123, and two limiter grooves 126 respectively located on the two opposite lateral sidewalls thereof at the rear side. Further, the connector body 1 further comprises a rear cover 15 located on the rear side of the first connection port 11 above the electrically insulative base member 12. The rear cover 15 defines an open space 151 that is surrounded by the top wall, back wall and two opposing sidewalls of the rear cover 15, having a plurality of locating flanges 153 respectively from the front side and bottom sides thereof around the open space 151 and respectively engaged into the receiving chamber 116 and the locating grooves 1171 of the lugs 117 and a locating block 152 located on the bottom side of the back wall thereof and stopped against the front side of the stop block 125. Thus, the rear cover 15 is firmly secured to the first connection port 11 and the bottom positioning member 12 to shield the rear bonding portions 1122;1232 of the first conducting terminals 112 and second conducting terminals 113 of the first connection port 11, the adapter terminals 124 and the circuit module 2.

Referring to FIGS. 5~7 again, as stated above, the connector body 1 consists of the first connection port 11, the bottom positioning member 12, the insulative base member 13, the second connection port 14 and the rear cover 15. Further, the connection block 3 comprises a stop block 34 protruded from the top wall thereof at a rear side relative to the terminal slots 31 for stopping against the rear cover 15, two locating grooves 35 respectively located on the two opposite lateral sidewalls thereof. When the respective locating flanges 153 of the rear cover 15 are respectively engaged into the receiving chamber 116 and the locating grooves 1171 of the lugs 117, the bottom-sided locating flanges 153 of the rear cover 15 are respectively engaged into the locating grooves 35 of the connection block 3, enhancing positioning stability of the rear cover 15 so that the rear cover 15 effectively shields the rear bonding portions 1122;1232 of the first conducting terminals 112 and second conducting terminals 113 of the first connection port 11, the adapter terminals 124 and the circuit module 2 and prohibit them from contacting the metal shield 4 to cause a short circuit.

While only certain embodiments of the present invention have been described in detail for purposes of illustration various modifications and enhancements may be made thereunto without departing from the spirit and scope of the invention. Accordingly, the invention is not to be limited except as by the appended claims.

What the invention claimed is:

1. A USB connector, comprising:

an connector body, said connector body comprising a first connection port, a bottom positioning member fastened to a bottom side of said first connection port and a rear cover covering said first connection port and said an electrically insulative base member at a rear side, said first connection port comprising a forwardly extending tongue plate, a set of first conducting terminals and a set of second conducting terminals respectively mounted in top and bottom sides of the tongue plate of said first connection port, said first conducting terminals and said second conducting terminals each having a front contact portion and a rear bonding portion, the front contact portions of said first conducting terminals and said second conducting terminals being arranged in two rows in a staggered manner for the contact of an inserted external USB connector, the rear bonding portions of said first conducting terminals and said second conducting terminals extending out of the rear side of said first connection port for bonding to an external circuit board, said electrically insulative base member comprising a plurality of terminal slots vertically cut through top and bottom sides thereof and a set of adapter terminals respectively mounted in the terminal slots, each said adapter terminal having one end terminating in a connection portion and an opposite end terminating in a bonding portion, said rear cover being fastened to the rear side of said first connection port and a top side of said bottom positioning member to shield said first conducting terminals and second conducting terminals and said adapter terminals; and a circuit module disposed at a rear side relative to said connector body and surrounded by said rear cover, said circuit module comprising an adapter board, said adapter board comprising a plurality of first contacts located on a front side thereof for the bonding of the rear bonding portions of said first conducting terminals and said second conducting terminals and a plurality of first metal pads located on a rear side thereof for the bonding of the bonding portions of said adapter terminals.

2. The USB connector as claimed in claim 1, wherein said circuit module further comprises a plurality of electronic components installed in said adapter board and electrically connected between said first contacts and said first metal pads.

3. The USB connector as claimed in claim 1, wherein the tongue plate of said first connection port comprises a plurality of bottom terminal grooves for the positioning of said second conducting terminals; said first connection port comprises a plurality of bottom hooks and bottom mounting rods; said bottom positioning member comprises a plurality of terminal slots vertically cut through top and bottom sides thereof for the mounting of said adapter terminals, and a plurality of retaining blocks and retaining holes respectively forced into engagement with the bottom hooks and bottom mounting rods of said first connection port; the USB connector further comprises a metal shield surrounding said connector body and said circuit module and defining a front insertion hole for the insertion of an external USB connector.

4. The USB connector as claimed in claim 1, wherein the tongue plate of said first connection port of said connector body comprises a receiving chamber located on the rear side thereof for accommodating said circuit module, and two lugs respectively vertically disposed at two opposite lateral sides of said receiving chamber, each said lug having a locating groove located on a bottom side thereof; said bottom positioning member further comprises a stop block protruded from a top wall thereof at a rear side relative to the terminal slots and two limiter grooves respectively located on two opposite lateral sidewalls thereof; said rear cover defines an open space, having a plurality of locating flanges respectively from front side and bottom sides thereof around said open space and respectively engaged into the receiving chamber and the locating grooves of said lugs and a locating block located on a bottom side of a back wall thereof and stopped against a front side of the stop block of said bottom positioning member.

5. The USB connector as claimed in claim 1, wherein said first conducting terminals include a grounding terminal (GND_DRAIN) set in between each of two pairs of signal terminals (StdA_SSRX−; StdA_SSRX+ and StdA_SSTX−; StdA_SSTX+) thereof; said second conducting terminals include a power terminal (VBUS) and a power grounding terminal (GND) respectively arranged at left and right sides of a pair of signal terminals (D− and D+) thereof; said circuit module further comprises a plurality of electronic components installed in said adapter board and electrically connected between said first contacts and said first metal pads.

6. The USB connector as claimed in claim 5, wherein said electronic components include a plurality of filter devices selected from the group of common mode choke, filter resistor and filter capacitor and arranged in two rows and electrically connected between signal input ends and signal output ends of said adapter board to which the signal terminals (StdA_SSRX−, StdA_SSRX+, StdA_SSTX−, StdA_SSTX+, D− and D+) of said first conducting terminals and said second conducting terminals are electrically connected.

7. The USB connector as claimed in claim 5, wherein said electronic components include a plurality of protection devices selected from the group of TVS (transient voltage suppressor) and varistor for protection against surge and static electricity and electrically connected between signal input ends and signal output ends of said adapter board to which the terminals (SSTX−, StdA_SSTX+, GND DRAIN, SSTX− and SSTX+ of said first conducting terminals and the terminals (VBUS, D−, D+ and GND) of said second conducting terminals are electrically connected.

8. The USB connector as claimed in claim 5, wherein said first conducting terminals include an identification terminal (ID) connected between the signal terminal (D+) and power grounding terminal (GND) thereof.

9. The USB connector as claimed in claim 5, wherein said first conducting terminals include a power terminal (DPWR) and a power grounding terminal (DGND) set between the two pairs of signal terminals (StdB SSRX−; SStdB SRX+) thereof remote from the signal grounding terminal (GND_DRAIN).

10. The USB connector as claimed in claim 1, wherein said connector body further comprises an electrically insulative base member holding said first connection port and a second connection port arranged at a bottom side of said electrically insulative base member, said second connection port comprising a forwardly extending tongue plate and a set of first conducting terminals and a set of second conducting terminals mounted in top and bottom sides of the tongue plate of said second connection port, the tongue plate of said second connection port comprising a plurality of terminal grooves located on the bottom side thereof, the second conducting terminals of said second connection port being respectively positioned in the bottom terminal grooves of the tongue plate of said second connection port, the first conducting terminals and second conducting terminals of said second connection port each comprising a front contact portion suspending below the tongue plate of said second connection port for the contact of an inserted external USB connector and a rear bonding portion extending out of the rear side of said second connection port; said adapter board further comprises a set of second contacts and a set of second metal pads respectively arranged at the rear side thereof; the rear bonding portions of the first conducting terminals and second conducting terminals of said first connection port are respectively electrically bonded to the first contacts of said adapter board; the rear bonding portions of the first conducting terminals and second conducting terminals of said second connection port are respectively electrically bonded to the second contacts of said adapter board; the USB connector further comprises a connection block, said connection block comprising a plurality of terminal slots vertically extending through top and bottom sides thereof and a plurality of locating grooves located on the top side thereof and respectively extended from respective top ends of said terminal slots, and a plurality of metal connection terminals respectively mounted in the terminal slots of said connection block, each said metal connection terminal comprising a connection portion located on one end thereof and a bonding portion located on an opposite end thereof and a curved middle portion connected between the connection portion and the bonding portion, the bonding portions of said metal connection terminals extending out of the terminal slots of said connection block, the curved middle portions of said metal connection terminals being respectively positioned in the locating grooves of said connection block.

11. The USB connector as claimed in claim 10, wherein said circuit module further comprises a set of second contacts for the bonding of the rear bonding portion of the first conducting terminals and second conducting terminals of said second connection port, and a set of second metal pads respectively arranged at the rear side thereof for the bonding of the connection portions of said metal connection terminals.

12. The USB connector as claimed in claim 11, wherein said electronic components include a plurality of filter devices selected from the group of common mode choke, filter resistor and filter capacitor and arranged in two rows and electrically connected between signal input ends and signal output ends of said adapter board to which the signal terminals (SSRX−, SSRX+, SSTX−, SSTX+, D− and D+) of the first conducting terminals and second conducting terminals of said first connection port and said second connection port are electrically connected.

13. The USB connector as claimed in claim 11, wherein said electronic components include a plurality of protection devices selected from the group of TVS (transient voltage suppressor) and varistor for protection against surge and static electricity and electrically connected between signal input ends and signal output ends of said adapter board to which the terminals (SSTX−, StdA_SSTX+, GND DRAIN, SSTX− and SSTX+ of the first conducting terminals of said first connection port and said second connection port and the terminals (VBUS, D−, D+ and GND) of the second conducting terminals of said first connection port and said second connection port are electrically connected.

14. The USB connector as claimed in claim 10, wherein said electrically insulative base member comprises a plurality of retaining blocks and a plurality of retaining holes; said first connection port comprises a plurality of bottom hooks and a plurality of bottom mounting rods respectively forced into engagement with the retaining blocks and retaining holes of said electrically insulative base member; said second connection port comprises a plurality of retaining blocks respectively forced into engagement with the bottom hooks of said electrically insulative base member and a plurality of retaining holes respectively forced into engagement with the bottom mounting rods of said electrically insulative base member.

15. The USB connector as claimed in claim 10, further comprising a metal shield surrounding said connector body and said circuit module, said metal shield comprising a front frame shell, a rear cover shell and an internal clamping shell, said front frame shell comprising a plurality of spring lugs, said front frame shell and said rear cover shell being fastened together and covered over said connector body, said internal clamping shell being clamped on said electrically insulative base member of said connector body, and stopped against the spring lugs of said front frame shell, said internal clamping shell dividing the internal space of said front frame shell into two insertion holes for receiving one respective external USB connector.

16. The USB connector as claimed in claim 10, wherein the tongue plate of said first connection port of said connector body comprises a receiving chamber located on the rear side thereof for accommodating said circuit module, and two lugs respectively vertically disposed at two opposite lateral sides of said receiving chamber, each said lug having a locating groove located on a bottom side thereof; said connection block comprises a stop block protruded from atop wall thereof at a rear side relative to the terminal slots thereof for stopping against said rear cover and two locating grooves respectively located on two opposite lateral sidewalls thereof; said bottom positioning member further comprises a stop block protruded from a top wall thereof at a rear side relative to the terminal slots and two limiter grooves respectively located on two opposite lateral sidewalls thereof; said rear cover defines an open space, having a plurality of locating flanges respectively from front side and bottom sides thereof around said open space and respectively engaged into the receiving chamber and the locating grooves of said lugs and the locating grooves of said connection block and a locating block located on a bottom side of a back wall thereof and stopped against a front side of the stop block of said bottom positioning member.

* * * * *